US010828903B2

(12) United States Patent
Yoda et al.

(10) Patent No.: US 10,828,903 B2
(45) Date of Patent: Nov. 10, 2020

(54) INK ABSORBING MEMBER ACCOMMODATION CONTAINER AND INK ABSORBING STRUCTURE

(71) Applicant: Seiko Epson Corporation, Tokyo (JP)

(72) Inventors: Kaneo Yoda, Okaya (JP); Yoichi Miyasaka, Suwa (JP); Nobutaka Urano, Matsumoto (JP); Seiichi Taniguchi, Asahi (JP); Akio Ito, Matsumoto (JP); Shunichi Seki, Suwa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 16/364,354

(22) Filed: Mar. 26, 2019

(65) Prior Publication Data

US 2019/0299629 A1 Oct. 3, 2019

(30) Foreign Application Priority Data

Mar. 27, 2018 (JP) ..... 2018-059712

(51) Int. Cl.
*B41J 2/175* (2006.01)
*B41J 2/185* (2006.01)
*B41J 2/165* (2006.01)

(52) U.S. Cl.
CPC ..... *B41J 2/17513* (2013.01); *B41J 2/16508* (2013.01); *B41J 2/16523* (2013.01); *B41J 2/185* (2013.01)

(58) Field of Classification Search
CPC .... B41J 2/16508; B41J 2/16523; B41J 2/175; B41J 2/17513; B41J 2/185; B41J 2002/1856; A61F 13/58; A61F 13/5323; Y10T 442/3244; Y10T 442/6461; Y10T 442/652
See application file for complete search history.

(56) References Cited

U.S. PATENT DOCUMENTS 6,790,798 B1 9/2004 Suzuki et al.
2011/0192913 A1* 8/2011 Matsumoto ..... B41J 2/16508 239/101
2012/0050399 A1* 3/2012 Tanaka ..... B41J 2/16532 347/30
2012/0229563 A1* 9/2012 Miyazawa ..... B41J 2/16523 347/30

(Continued)

FOREIGN PATENT DOCUMENTS

JP 405113717 * 5/1993 ..... G03G 15/08
JP 2000-024033 A 1/2000
JP 3196933 B2 8/2001

(Continued)

*Primary Examiner* — Anh T Vo
(74) *Attorney, Agent, or Firm* — Harness, Dickey & Pierce, P.L.C.

(57) ABSTRACT

An ink absorbing member accommodation container includes: an accommodation container that has an accommodation space for accommodating an ink absorbing member containing water-absorbable resin capable of absorbing ink inside the accommodation container and that includes an inlet port through which the ink flows into the accommodation space; and a flying preventing mechanism that prevents a constituent material of the ink absorbing member from flying from the inlet port to an outside of the accommodation container.

6 Claims, 8 Drawing Sheets

(56) References Cited

U.S. PATENT DOCUMENTS

| | | | | |
|---|---|---|---|---|
| 2013/0300799 | A1* | 11/2013 | Mizutani | B41J 2/16505 347/30 |
| 2014/0176643 | A1* | 6/2014 | Komaki | B41J 2/1721 347/36 |

FOREIGN PATENT DOCUMENTS

| | | | | |
|---|---|---|---|---|
| JP | 3536870 | B2 | 6/2004 | |
| JP | 02005131868 | * | 5/2005 | B41J 2/185 |
| JP | 2011-046108 | A | 3/2011 | |
| JP | 2015-142909 | A | 8/2015 | |
| WO | WO-2018-008758 | A1 | 1/2018 | |

* cited by examiner

INK ABSORBING MEMBER ACCOMMODATION CONTAINER AND INK ABSORBING STRUCTURE

BACKGROUND

1. Technical Field

The present invention relates to an ink absorbing member accommodation container and an ink absorbing structure.

2. Related Art

An ink jet printer, waste ink is typically generated when a head cleaning operation that is performed to prevent degradation of print quality due to clogging of ink and an ink filling operation after replacement of an ink cartridge are performed. Thus, a liquid absorbing member (ink absorbing member) that absorbs the waste ink is provided in order to prevent unintended adhesion of such waste ink to devices or the like inside the printer.

In the related art, a liquid absorbing member (ink absorbing member) that includes natural cellulose fiber and/or synthesized fiber and a thermal-bonding substance has been used (see Japanese Patent No. 3536870, for example). The liquid absorbing member includes highly water-absorbable resin, and this enhances absorbability of the liquid absorbing member. Such a liquid absorbing member is typically mounted on an ink jet printer in a state in which the liquid absorbing member is accommodated in a hard container.

An inlet port through which ink flows into the container is provided at the container, and the ink is supplied into the container from the inlet port. In a case in which the ink is dropped toward the inlet port, there is a probability that a constituent material of a liquid absorbing member flies as dust due to impact occurring when the ink lands on the ink absorbing member depending on the constituent material of the liquid absorbing member (ink absorbing member). If the flying dust is released to the outside of the container, there is a probability that the dust enters the nozzles located outside the container and causes nozzle clogging, for example.

SUMMARY

An advantage of some aspects of the invention is to provide an ink absorbing member accommodation container and an ink absorbing structure capable of preventing a constituent material of an ink absorbing member from flying from an inlet port to the outside of the accommodation container.

The invention can be realized as follows.

According to an aspect of the invention, there is provided an ink absorbing member accommodation container including: an accommodation container that has an accommodation space for accommodating an ink absorbing member containing water-absorbable resin capable of absorbing ink inside the accommodation container and that includes an inlet port through which the ink flows into the accommodation space; and a flying preventing mechanism that prevents a constituent material of the ink absorbing member from flying from the inlet port to an outside of the accommodation container.

In this configuration, it is possible to prevent the constituent material of the ink absorbing member from flying the inlet port to the outside of the accommodation container. Therefore, it is possible to prevent the constituent material of the ink absorbing member from entering nozzles and the like located outside the accommodation container.

In the ink absorbing member accommodation container, it is preferable that the flying preventing mechanism have a shutter capable of opening and closing the inlet port.

In this configuration, it is possible to prevent the constituent material of the ink absorbing member from flying from the inlet port to the outside of the accommodation container by blocking the inlet port with the shutter.

In the ink absorbing member accommodation container, it is preferable that the flying preventing mechanism have a control section that controls operations of the shutter in synchronization with passing of the ink through the inlet port.

In this configuration, it is possible to achieve an opened state at a timing at which the ink passes through the inlet port and to achieve a closed state after the passing of the ink is completed. That is, it is possible to achieve both the passing of the ink and the prevention of the constituent material of the ink absorbing member from flowing out.

In the ink absorbing member accommodation container, it is preferable that the flying preventing mechanism have an air flow formation section that forms an air flow moving across the inlet port outside the inlet port.

In this configuration, it is possible to prevent the constituent material of the ink absorbing member from flying from the inlet port to the outside of the accommodation container by forming the air flow moving across the inlet port.

In the ink absorbing member accommodation container, it is preferable that the flying preventing mechanism have a control section that controls operations of the air flow formation section in synchronization with passing of the ink through the inlet port.

In this configuration, it is possible to achieve the opened state at which the ink passes through the inlet port and to achieve the closed state after the passing of the ink is completed. That is, it is possible to achieve both the passing of the ink and the prevention of the constituent material of the ink absorbing member from flowing out.

In the ink absorbing member accommodation container, it is preferable that the flying preventing mechanism have a negative pressure formation section that reduces a pressure in the accommodation space to a negative pressure.

In this configuration, it is possible to prevent the constituent material of the ink absorbing member from flowing from the inlet port to the outside of the accommodation container by reducing the pressure in the accommodation space to a negative pressure.

In the ink absorbing member accommodation container, it is preferable that the flying preventing mechanism have a check valve provided at the inlet port.

In this configuration, it is possible to prevent the constituent material of the ink absorbing member from flying from the inlet port to the outside of the accommodation container with a simple configuration in which the check valve is provided at the inlet port.

In the ink absorbing member accommodation container, it is preferable that a constituent material of the ink absorbing member include the water-absorbable resin and fiber that retains the water-absorbable resin.

In this configuration, it is possible to more obviously obtain the advantages of the invention since such ink absorbing member relatively easily flies as dust.

In the ink absorbing member accommodation container, it is preferable that the fiber be a fiber-separated product in a cotton form.

In this configuration, it is possible to more obviously obtain the advantages of the invention since the fiber-separated product relatively easily flies as dust.

According to another aspect of the invention, there is provided an ink absorbing structure including: the ink absorbing member accommodation container according to the invention; and an ink absorbing member that is accommodated in the ink absorbing member accommodation container and that includes a water-absorbable resin capable of absorbing ink.

In this configuration, it is possible to prevent the constituent material of the ink absorbing member from flying from the inlet port to the outside of the accommodation container. Therefore, it is possible to prevent the constituent material of the ink absorbing member from entering nozzles and the like located outside the accommodation container.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink absorbing member accommodation container and an ink absorbing structure according to the invention will be described in detail on the basis of preferred embodiments illustrated in the accompanying drawings.

First Embodiment

Figure 1:
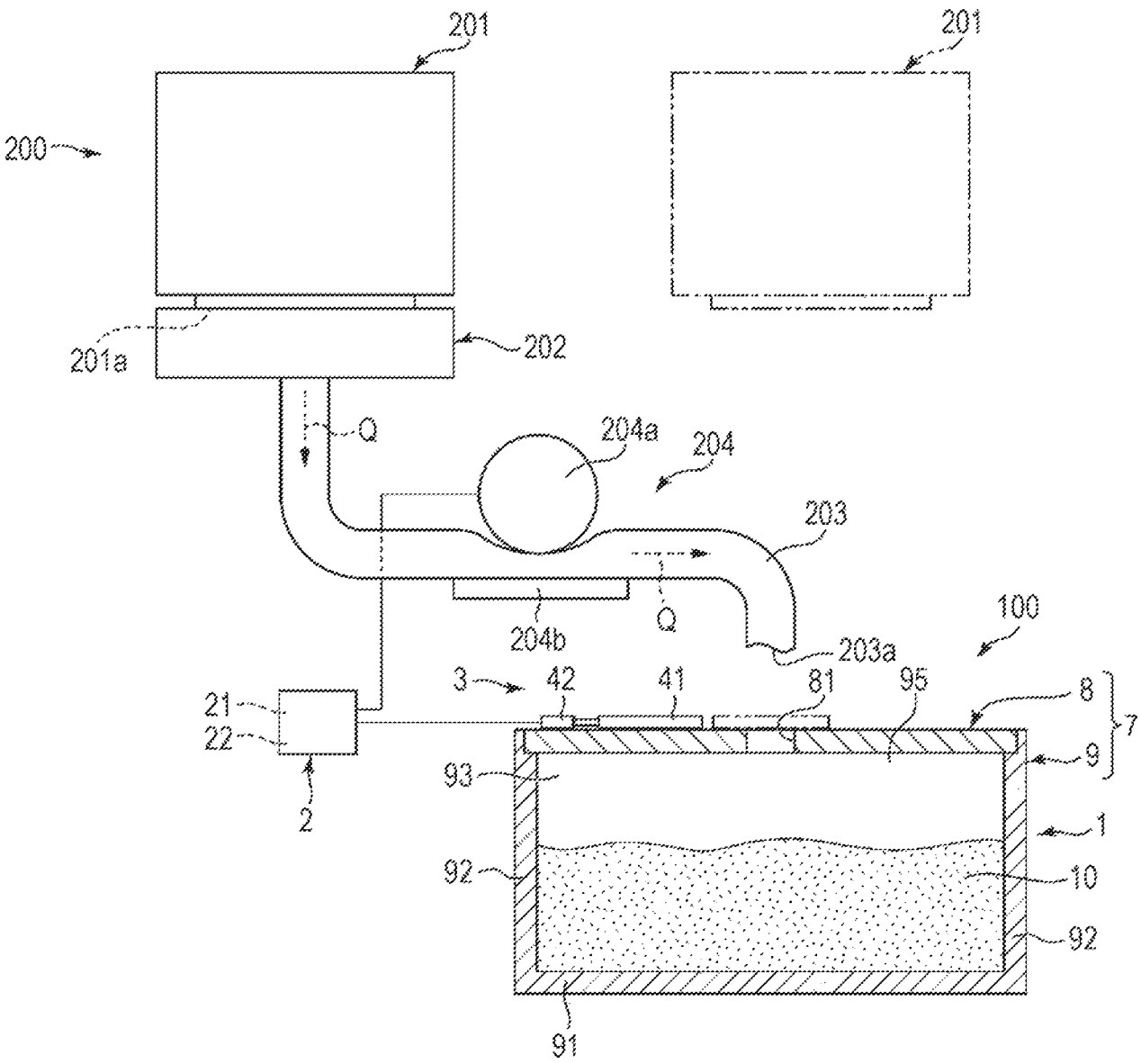
FIG. 1 is a partial vertical sectional view illustrating a state (example) in which an ink absorbing structure (ink absorbing member accommodation container) according to a first embodiment of the invention is state, in order.
Figure 2:
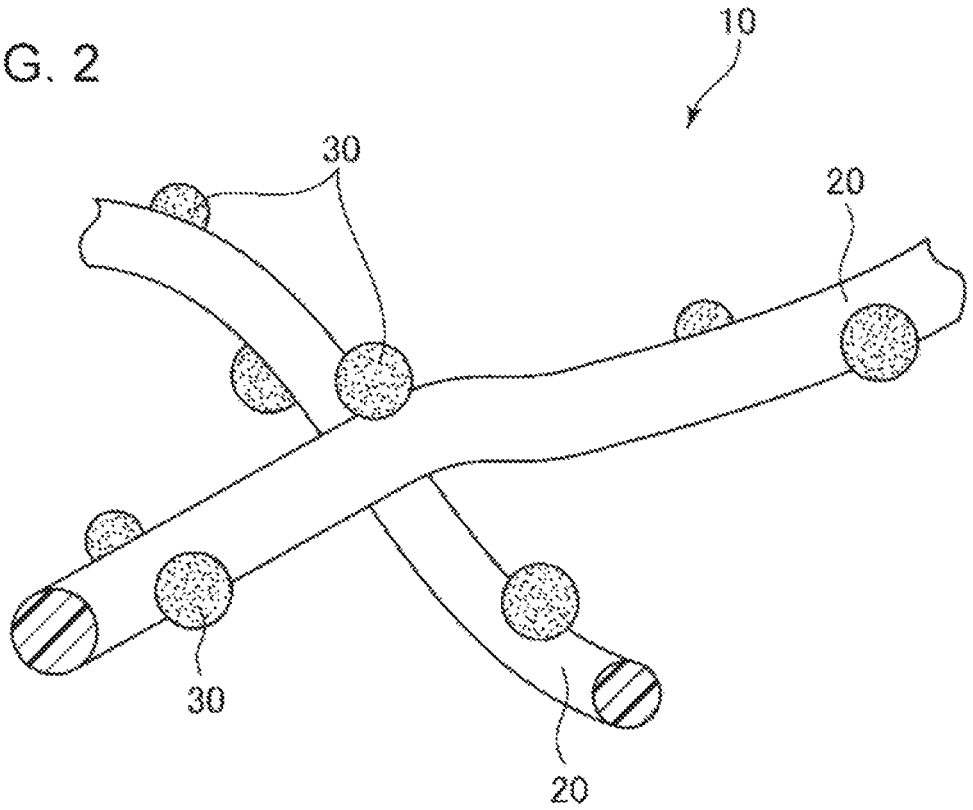
FIG. 2 is an enlarged detailed diagram of ink absorbing members included in the ink absorbing structure illustrated in FIG. 1.
Figure 3:
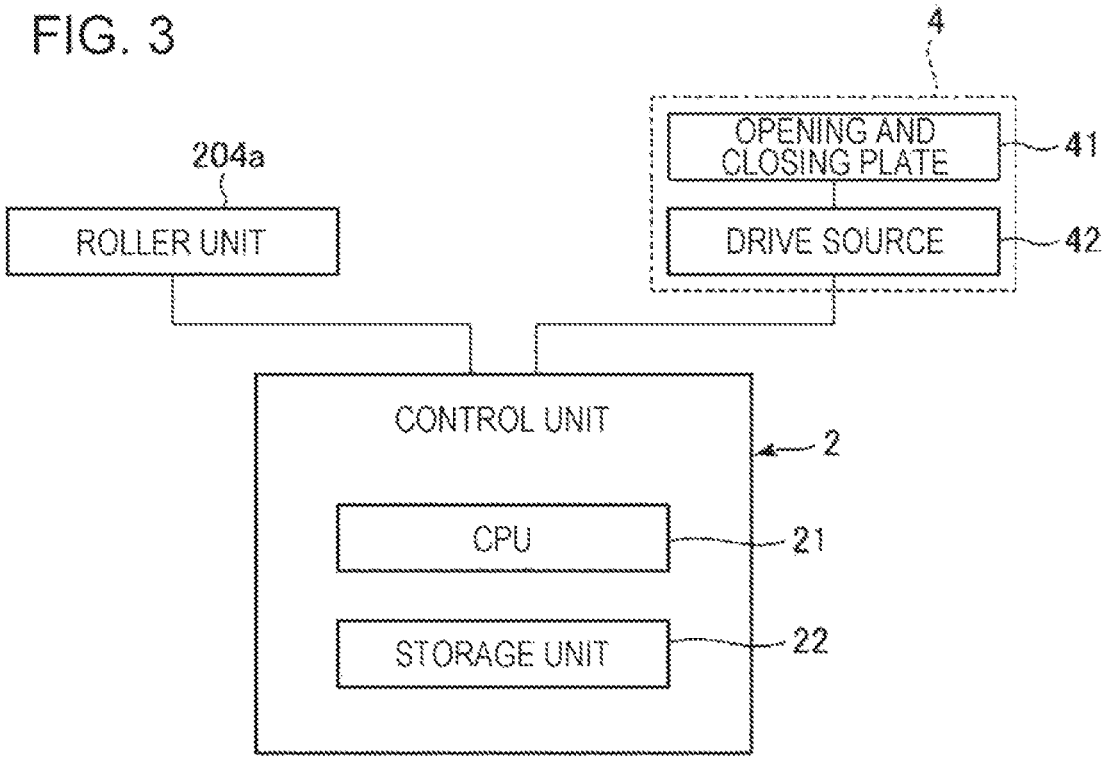
FIG. 3 is a block diagram of the ink absorbing structure (ink absorbing member accommodation container) illustrated in FIG. 1.
Figure 4:
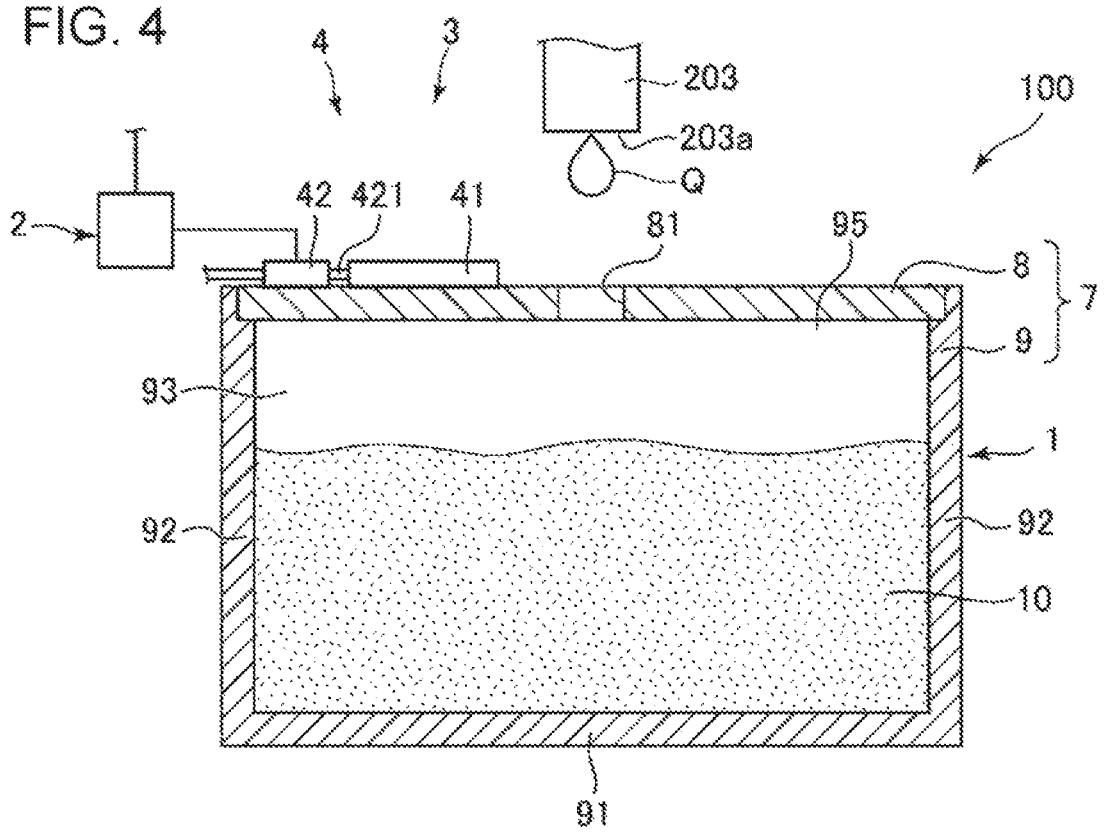
FIG. 4 is a partial vertical sectional view of the ink absorbing structure (ink absorbing member accommodation container) illustrated in FIG. 1 and is a diagram illustrating a state in which a shutter is in an opened state.
Figure 5:
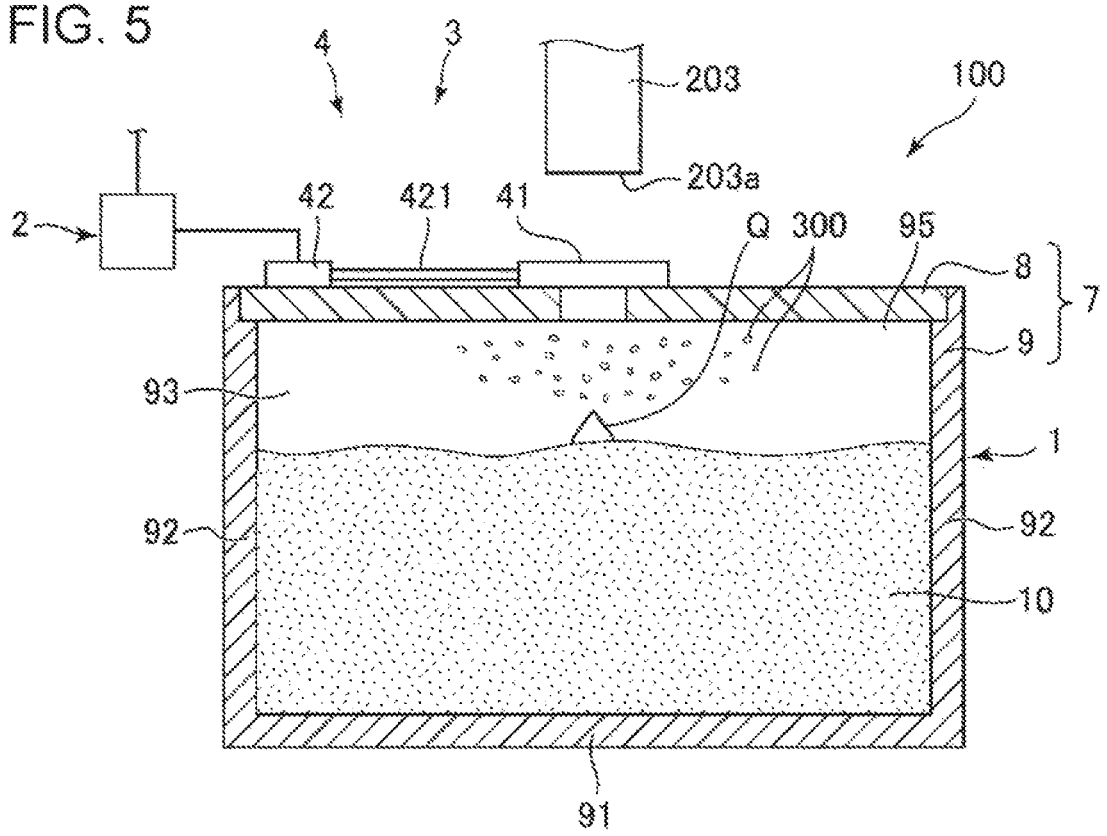
FIG. 5 is a partial vertical sectional view of the ink absorbing structure (ink absorbing member accommodation container) illustrated in FIG. 1 and is a diagram illustrating a state in which the shutter is in a closed state.
Figure 6:
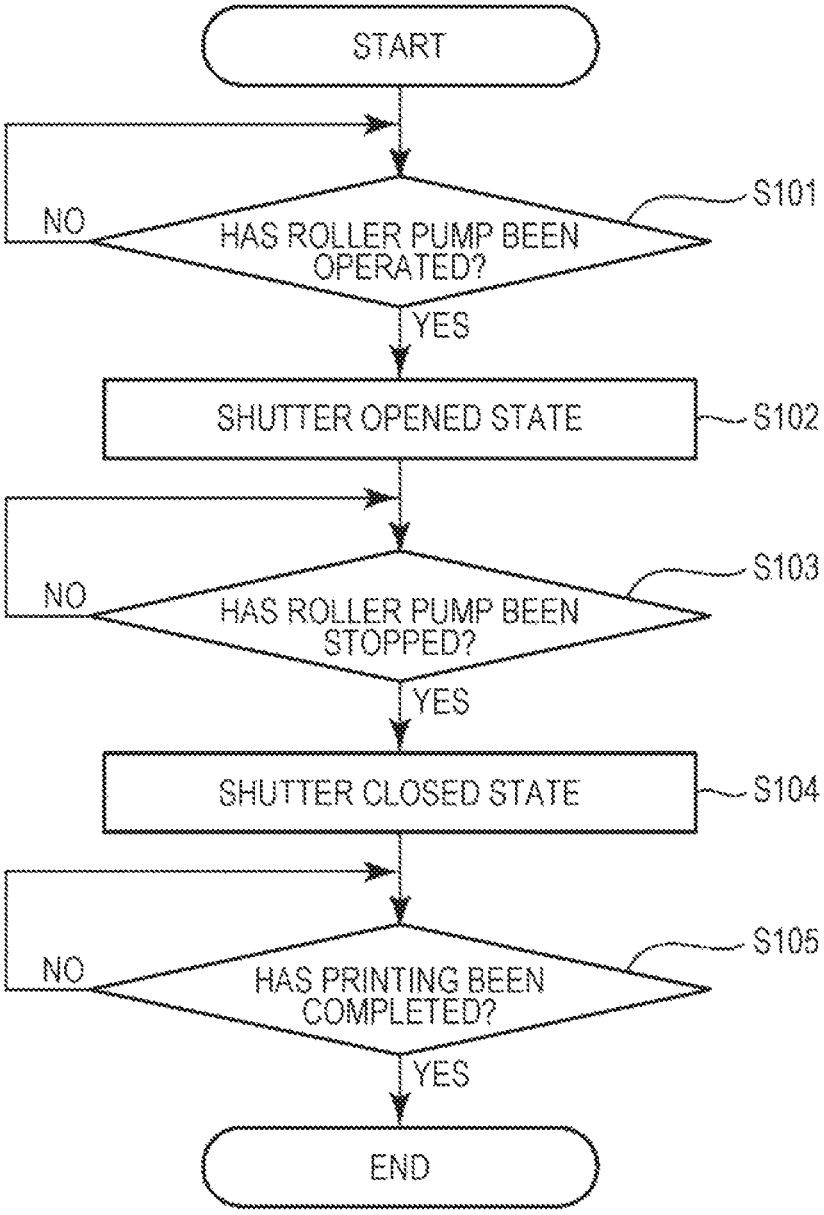
FIG. 6 is a flowchart for describing control operations of a control section illustrated in FIG. 3.

FIG. 1 is a partial vertical sectional view illustrating a state (example) in which an ink absorbing structure (ink absorbing member accommodation container) according to a first embodiment of the invention is used, in order. FIG. 2 is an enlarged detailed diagram of ink absorbing members included in the ink absorbing structure illustrated in FIG. 1. FIG. 3 is a block diagram illustrating the ink absorbing structure (ink absorbing member accommodation container) illustrated in FIG. 1. FIG. 4 is a partial vertical sectional view of the ink absorbing structure (ink absorbing member accommodation container) illustrated in FIG. 1 and is a diagram illustrating a state in which a shutter is in an opened state. FIG. 5 is a partial vertical sectional view of the ink absorbing structure (ink absorbing member accommodation container) illustrated in FIG. 1 and is a diagram illustrating a state in which the shutter is in a closed state. FIG. 6 is a flowchart for describing control operations of the control section illustrated in FIG. 3.

Note that the upper side in FIGS. 1, 4, and 5 (the same also applies to FIGS. 7 to 11) will be referred to as "upward (or above)" and the lower side will be referred to as "downward (or below)" in the following description for convenience of explanation.

As illustrated in FIGS. 1 and 2, the ink absorbing member accommodation container 1 according to the invention includes an accommodation container 7 that has an accommodation space 93 for accommodating ink absorbing members 10 containing water-absorbable resin 30 capable of absorbing ink Q inside the accommodation space 93 and that includes an ink supply port 81 (inlet port) through which the ink Q flows into the accommodation space 93 and a flying preventing mechanism 3 that prevents a constituent material of the ink absorbing member 10 from flying from the ink supply port 81 (inlet port) to the outside of the accommodation container 7.

The ink absorbing structure 100 according to the invention includes the ink absorbing member accommodation container 1 and the ink absorbing members 10 that is accommodated in the ink absorbing member accommodation container 1 and contains the water-absorbable resin 30 capable of absorbing the ink Q.

According to the invention as described above, it is possible to prevent the constituent material of the ink absorbing member 10 from flying from the ink supply port 81 (inlet port) to the outside of the accommodation container 7. Therefore, it is possible to prevent the constituent material of the ink absorbing member 10 from entering nozzles and the like located outside the accommodation container 7.

Note that "water absorption" described in the specification means that water-based ink obtained by dissolving a coloring material in a water-based solvent is absorbed of course, and it also means that general ink such as solventbased ink obtained by dissolving a binder in a solvent, UV-curable ink obtained by dissolving a binder in a monomer in the form of liquid that is cured by UV irradiation, and latex ink obtained by dissolving a binder in a dispersing medium is absorbed.

A print apparatus 200 illustrated in FIG. 1 is an ink jet-type color printer, for example. The print apparatus 200 includes an ink ejection head 201 that ejects the ink Q, a capping section 202 that prevents clogging of nozzles 201*a* of the ink ejection head 201, a tube 203 that couples the capping section 202 to the ink absorbing structure 100, and a roller pump 204 that feeds the ink Q from the capping section 202 to the ink absorbing structure 100.

The ink ejection head 201 has a plurality of nozzles 201*a* that eject the ink Q downwardly. The ink ejection head 201 can perform printing (see the ink ejection head 201 illustrated by the two-dotted chain line in FIG. 1) by ejecting the ink Q while moving relative to a recording medium (not illustrated) such as a PPC sheet.

The capping section 202 prevents clogging of the nozzles 201*a* by collectively suctioning the respective nozzles 201*a* through an operation of the roller pump 204 when the ink ejection head 201 is at a stand-by location.

The tube 203 is configured such that the ink Q suctioned via the capping section 202 passes therethrough toward the ink absorbing structure 100. The tube 203 has flexibility.

The roller pump 204 is disposed in a midpoint of the tube 203 and has a roller section 204*a* and a pinching section 204*b* that pinches the midpoint of the tube 203 with the roller section 204*a*. Suctioning force is generated in the capping section 202 via the tube 203 by the roller section 204*a* rotating. The ink Q adhering to the nozzles 201*a* can be fed to the ink absorbing structure 100 by the roller section 204*a* continuously rotating. Then, the ink Q is absorbed by the ink absorbing structure 100 as waste liquid. Note that ink with various colors is included in the ink Q.

As illustrated in FIG. 1, the ink absorbing structure 100 includes an ink absorbing member accommodation container 1 and the ink absorbing members 10 that are used to absorb the ink Q. The ink absorbing structure 100 is detachably attached to the print apparatus 200 and is used to absorb the waste liquid of the ink Q as described above in the attached state. In this manner, it is possible to use the ink absorbing structure 100 as a so-called "waste liquid tank (waste ink tank)". If the amount of the ink Q absorbed by the ink absorbing structure 100 reaches a limit, it is possible to replace the ink absorbing structure 100 with a new (unused) ink absorbing structure 100. Note that whether or not the amount of the ink Q absorbed by the ink absorbing structure 100 has reached the limit is detected by a detection section (not illustrated) in the print apparatus 200. If the amount of the ink Q absorbed by the ink absorbing structure 100 has reached the limit, a notification section such as a monitor that is incorporated in the print apparatus 200 provides a notification of the fact, for example.

The ink absorbing member 10 is used to absorb the ink Q in the ink absorbing member accommodation container 1. As illustrated in FIG. 2, the ink absorbing member 10 includes the fiber 20 and the water-absorbable resin 30 adhering to (retained by) the fiber 20, and the ink absorbing members 10 are in the cotton form as a whole in the embodiment. Note that the fiber 20 is preferably bonded to each other via a binder (not illustrated).

Since the constituent material of the ink absorbing member 10 relatively easily flies as dust if the constituent material contains the water-absorbable resin 30 and the fiber 20 retained by the water-absorbable resin 30, it is possible to more obviously obtain the advantages of the invention, which will be described later.

When the ink Q is applied to the ink absorbing members 10 by the fiber 20, the fiber 20 can once hold the ink Q, the water-absorbable resin 30 can then efficiently feed the ink Q, and ink Q absorbability of the entire ink absorbing members 10 can be improved. Also, fiber such as cellulose fiber (particularly, fiber derived from old paper) is typically more reasonable as compared with the water-absorbable resin 30 and is advantageous in terms of reduction of manufacturing cost of the ink absorbing members 10. Since fiber derived from old paper can suitably be used as the fiber 20, the fiber 20 is also advantageous in terms of reduction of waste, effective utilization of resources, and the like.

Examples of the fiber 20 include: synthesis resin fiber such as polyester fiber and polyamide fiber; natural resin fiber such as cellulose fiber, keratin fiber, and fibroin fiber and chemically modified products thereof, and the fiber can be used alone or can appropriately be mixed and used. However, the resin preferably contains cellulose fiber as a main constituent, and it is more preferable that substantially entire fiber be cellulose fiber.

Since cellulose is a material that has suitable hydrophilicity, the ink absorbing members 10 can suitably take the ink Q when the ink Q is applied to the ink absorbing members 10, can quickly get out from a state in which liquidity is particularly high (a state in which viscosity is equal to or less than 10 mPa·s, for example), and can suitably feed the ink Q that the ink absorbing members 10 have once taken to the water-absorbable resin 30. As a result, it is possible to obtain particularly excellent the ink Q absorption properties of all the ink absorbing members 10. Since cellulose typically has high affinity with the water-absorbable resin 30, it is possible to cause the surface of the fiber 20 to more suitably retain the water-absorbable resin 30. Since cellulose fiber is a reproducible natural material and is available at low cost from among various kinds of fiver, the cellulose fiber is advantageous in terms of reduction of production cost of the ink absorbing members 10, stable production, reduction of an environmental burden, and the like.

Note that in the specification, the cellulose fiber may be any fiber that contains cellulose in the form of a compound (cellulose in a narrow sense) as a main constituent and that has a fiber shape, and fiber that contains hemicellulose or lignin in addition to cellulose (cellulose in a narrow sense) may be employed.

The fiber 20 may be included in the ink absorbing members 10 in a cotton shape or may be mold into a sheet shape, a strip shape, a small piece, or the like.

As a raw material of the fiber 20, old paper may be used, for example. This leads to the aforementioned advantages and is preferable in terms of saving of resources. When old paper is used as a raw material of the fiber 20, the old paper may be used as it is, a crushed product obtained by performing crushing processing or a fiber-separated product in a cotton form obtained by fiber separation processing may be used. Among them, the fiber 20 is preferably the fiber-separated product in the cotton form. Since the fiber-separated product relatively easily flies as dust, it is possible to more obviously obtain the advantages of the invention as will be described later.

Although an average length of the fiber 20 is not particularly limited, the average length is preferably equal to or greater than 0.1 mm and equal to or less than 7 mm, is more preferably equal to or greater than 0.1 mm and equal to or less than 5 mm, and is further preferably equal to or greater than 0.1 mm and equal to or less than 3 mm.

Although an average width (diameter) of the fiber 20 is not particularly limited, the average width is preferably equal to or greater than 0.5 μm and equal to or less than 200 μm and is more preferably equal to or greater than 1.0 μm and equal to or less than 100 μm.

Although an average aspect ratio (a ratio of the average length with respect to the average width) of the fiber 20 is not particularly limited, the average aspect ratio is preferably equal to or greater than 10 and equal to or less than 1000 and is more preferably equal to or greater than 15 and equal to or less than 500.

If the numerical range as described above is satisfied, it is possible to more suitably perform retention of the water-absorbable resin 30, holding of the ink Q with the fiber 20, and feeding of the ink Q to the water-absorbable resin 30 and thereby to achieve more excellent ink absorbability of the entire ink absorbing members 10.

Although the water-absorbable resin 30 may be any resin with water absorbability and is not particularly limited, examples thereof include carboxymethyl cellulose, polyacrylic acid, polyacrylamide, a starch-acrylic acid graft copolymer, a hydrolysate of a starch-acrylonitrile graft copolymer, vinyl acetate-acrylic acid ester copolymer, a copolymer or the like of isobutylene and maleic acid, a hydrolysate of an acrylonitrile copolymer or an acrylamide copolymer, a polyethylene oxide, a polysulfone acid-based compound, a polyglutamic acid, salts (neutralized product) thereof, and crosslinked products. Here, the water absorbability means a function of holding moisture with hydrophilicity. Many kinds of water-absorbable resin 30 experience gelation if the water-absorbable resin 30 absorbs water.

Among them, resin that has a functional group in a side chain is preferably used as the water-absorbable resin 30. Examples of the functional group include an acid group, a hydroxyl group, an epoxy group, and an amino group.

In particular, the water-absorbable resin 30 is preferably resin that has an acid group in a side chain and is more preferably resin that has a carboxyl group in a side chain.

Examples of a unit containing a carboxyl group that forms the water-absorbable resin 30 include an acrylic acid, a methacrylic acid, an itaconic acid, a maleic acid, a crotonic acid, a fumaric acid, a sorbic acid, a cinnamic acid, and derivatives from monomers thereof such as anhydrides and salts.

When the water-absorbable resin 30 that has an acid group in a side chain is included, a proportion of a substance that is neutralized and forms a salt in the acid group included in the water-absorbable resin 30 is preferably equal to or greater than 30 mol % and equal to or less than 100 mol %, is more preferably equal to or greater than 50 mol % and equal to or less than 95 mol %, is further preferably equal to or greater than 60 mol % and equal to or less than 90 mol %, and is most preferably equal to or greater than 70 mol % and equal to or less than 80 mol %. In this manner, it is possible to achieve more excellent ink Q absorbability of the water-absorbable resin 30 (ink absorbing members 10).

Although the type of the neutralized salt is not particularly limited, and examples thereof include alkali metal salts such as a sodium salt, a potassium salt, and a lithium salt, and salts of nitrogen-containing basic products such as ammonia, a sodium salt is preferably used. In this manner, it is possible to achieve more excellent ink Q absorbability of the water-absorbable resin 30 (ink absorbing members 10).

The water-absorbable resin 30 that has an acid group in a side chain is preferably used since electrostatic repulsion occurs between acid groups during absorption of the ink and the absorption speed increases. Also, if the acid group is neutralized, the ink Q is easily absorbed into the water-absorbable resin 30 due to an osmotic pressure.

The water-absorbable resin 30 has a configuration unit that does not contain an acid group, and examples of such a configuration unit include a hydrophilic configuration unit, a hydrophobic configuration unit, and a configuration unit that serves as a polymerizable crosslinking agent.

Examples of the hydrophilic configuration unit includes configuration units derived from nonionic compounds such as acrylamide, methacrylamide, N-ethyl(meth)acrylamide, N-n-propyl(meth)acrylamide, N-isopropyl(meth)acrylamide, N,N-dimethyl(meth)acrylamide, 2-hydroxyethyl (meth) acrylate, 2-hydroxypropyl (meth)acrylate, methoxypolyethylene glycol (meth)acrylate, polyethylene glycol mono (meth)acrylate, N-vinylpyrrolidone, N-acryloylpiperidine, and N-acryloylpyrrolidine.

Examples of the hydrophobic configuration unit include configuration units derived from compounds such as (meth) acrylonitrile, styrene, vinyl chloride, butadiene, isobutene, ethylene, propylene, stearyl (meth)acrylate, and lauryl (meth) acrylate.

Examples of the configuration unit that serves as the polymerizable crosslinking agent include configuration units derived from diethylene glycol diacrylate, N,N'-methylene bis acrylamide, polyethylene glycol diacrylate, polypropylene glycol diacrylate, trimethylolpropane diallyl ether, trimethylolpropane triacrylate, allyl glycidyl ether, pentaerythritol triallyl ether, pentaerythritol diacrylate monostearate, bisphenol diacrylate, isocyanuric acid diacrylate, tetraallyloxyethane, a diallyloxyacetic salt.

The water-absorbable resin 30 preferably contains a polyacrylic acid salt copolymer or a polyacrylic acid polymerization crosslinked body. This is advantageous in terms of an improvement of ink Q absorption performance, manufacturing cost reduction, and the like.

A proportion of a configuration unit that has a carboxyl group with respect to all the configuration units that form a molecular chain in the polyacrylic acid polymerization crosslinked body is preferably equal to or greater than 50 mol %, is more preferably equal to or greater than 80 mol %, and is further preferably equal to or greater than 90 mol %.

If the proportion of the configuration unit containing the carboxyl group is excessively low, there is a probability that it becomes difficult to achieve sufficiently excellent ink Q absorption performance.

A part of the carboxyl group in the polyacrylic acid polymerization crosslinked body is preferably neutralized (partially neutralized) and forms a salt.

A proportion of a neutralized product with respect to the entire carboxyl group in the polyacrylic acid polymerization crosslinked body is preferably equal to or greater than 30 mol % and equal to or less than 99 mol %, is more preferably equal to or greater than 50 mol % and equal to or less than 99 mol %, and is further preferably equal to or greater than 70 mol % and equal to or less than 99 mol %.

In addition, the water-absorbable resin 30 may have a structure crosslinked with a crosslinking agent other than the aforementioned polymerizable crosslinking agent.

When the water-absorbable resin 30 is resin that has an acid group, a compound that has a plurality of functional groups that react with the acid group, for example, can preferably be used as the crosslinking agent.

When the water-absorbable resin 30 is resin that has a functional group that reacts with the acid group, a compound that has a plurality of functional groups that react with the acid group in a molecule can preferably be used as the crosslinking agent.

Examples of the compound (crosslinking agent) that has a plurality of functional groups that react with an acid group include: glycidyl ether compounds such as ethylene glycol diglycidyl ether, trimethylolpropane triglycidyl ether, (poly) glycerine polyglycidyl ether, diglycerine polyglycidyl ether, and propylene glycol diglycidyl ether; polyvalent alcohols such as (poly)clycerine, (poly)ethylene glycol, propylene glycol, 1,3-propanediol, polyoxyethylene glycol, triethylene glycol, tetraethylene glycol, diethanolamine, and triethanolamine; and polyvalent amines such as ethylenediamine, diethylenediamine, polyethyleneimine, and hexamethylenediamine. In addition, polyvalent ions such as zinc, calcium, magnesium, and aluminum can also suitably be used since they react with the acid group that the water-absorbable resin 30 has and function and crosslinking agents.

Although the water-absorbable resin 30 may be in any shape such as a scale shape, a needle shape, a fiber shape, a particle shape, or the like, the water-absorbable resin 30 is preferably in a particle shape. In the case in which the water-absorbable resin 30 is in the particle shape, it is possible to easily secure permeability of the ink Q. Also, it is possible to suitably cause the fiber 20 to retain the water-absorbable resin 30. Note that the average particle diameter of the particles is preferably equal to or greater than 15 μm and equal to or less than 800 μm, and is more preferably equal to or greater than 15 μm and equal to or less than 400 μm, and is further preferably equal to or greater than 15 μm and equal to or less than 50 μm.

Note that as the average particle diameter of the particles, it is possible to use a volume average mean volume diameter (MVD) measured by a laser refraction-type grain size distribution measurement device, for example. The grain size distribution measurement device using the laser refraction and scattering method as a measurement principle, that is, a laser refraction-type grain size distribution measurement device can measure grain size distribution on the basis of the volume.

The content of the water-absorbable resin 30 is preferably greater than 5% by weight and equal to or less than 90% by weight, is more preferably equal to or greater than 20% by weight and equal to or less than 70% by weight, and is further preferably equal to or greater than 40% by weight and equal to or less than 55% by weight with respect to the fiber 20.

When the average particle diameter of the water-absorbable resin 30 is assumed to be D [μm] and the average length of the fiber 20 is assumed to be L [μm], the relationship of $0.15 \leq L/D \leq 467$ is preferably satisfied, the relationship of $0.25 \leq L/D \leq 333$ is more preferably satisfied, and the relationship of $2 \leq L/D \leq 200$ is further preferably satisfied.

The ink absorbing member 10 may contain constituents (other constituents) other than those described above. Examples of such constituents include a surfactant, a lubricant, an antifoaming agent, a filler, an antiblocking agent, an ultraviolet absorbing agent, a coloring agent such as a pigment or a dye, a flame retardant, and a fluidity improver.

As illustrated in FIG. 1, the ink absorbing member accommodation container 1 includes a container main body 9 that has an accommodation space 93 for accommodating the ink absorbing members 10 and a cover 8 that is detachably attached to the container main body 9.

The container main body 9 has a box shape that has a bottom section (bottom plate) 91 that has a square shape, for example, in a plan view, and four side wall sections 92 that stand upward from the respective sides (edges) of the bottom section 91. It is possible to accommodate the ink absorbing members 10 in the accommodation space 93 surrounded by the bottom section 91 and the four side wall sections 92.

Note that the container main body 9 is not limited to a container main body that has a bottom section 91 with a square shape in a plan view, and the container main body 9 may have a bottom section 91 with a circular shape in a plan view and has a cylindrical shape as a whole.

When the volume of the container main body 9 (accommodation space 93) is assumed to V1 and the total volume of the ink absorbing member 10 before absorbing the ink Q (before water absorption) is assumed to V2, the ratio V2/V1 between V1 and V2 is preferably equal to or greater than 0.1 and equal to or less than 0.7 and is more preferably equal to or greater than 0.2 and equal to or less than 0.7 (see FIG. 1). In this manner, an air gap 95 is generated on the upper side of the ink absorbing members 10 in the container main body 9. The ink absorbing members 10 are once expanded (swell) after absorbing the ink Q. The air gap 95 serves as a buffer when the ink absorbing member 10 is expanded, and the ink absorbing members 10 can thus sufficiently absorb the ink Q.

In the embodiment, the container main body 9 is hard. That is, the container main body 9 has such shape holding properties that the volume V1 does not change by 10% or greater, for example, in a case in which an inner pressure or external force acts on the container main body 9. In this manner, the container main body 9 can maintain the shape of the container main body 9 itself even if the ink absorbing members 10 are expanded after absorbing the ink Q and the container main body 9 receive force from the ink absorbing members 10 from the inside. In this manner, the placement state of the container main body 9 in the print apparatus 200 is stabilized, and the ink absorbing members 10 can stably absorb the ink Q.

The constituent material of the container main body 9 is not particularly limited as long as the container main body 9 is formed of a material that does not allow the ink Q to penetrate therethrough. As such a constituent material of the container main body 9, it is possible to use various resin materials such as cyclic polyolefin or polycarbonate. Also, it is possible to use various metal materials such as aluminum or stainless steel, for example, as well as the various resin materials, as the constituent material of the container main body 9.

Note that the container main body 9 is not limited to the hard container main body, and a flexible container main body (soft), that is, a container main body with the volume V1 that changes by 10% or greater in a case in which an internal pressure or external force acts on the container main body 9 may be employed.

In addition, the container main body 9 may be transparent (including semi-transparent) with internal visibility or non-transparent.

As described above, the ink absorbing structure 100 includes the cover 8. As illustrated in FIG. 1, the cover 8 has a plate shape and can be fit into the upper opening of the container main body 9. It is possible to seal the upper opening in a liquid tight manner through the fitting. In this manner, it is possible to prevent the ink Q from flying outwardly even in a case in which the ink Q collides against the ink absorbing member 10 and jumps up when the ink Q is discharged and drops from the tube 203, for example. Therefore, it is possible to prevent the ink Q from adhering to and staining the surroundings of the ink absorbing structure 100.

An ink supply port (inlet port) 81 for supplying the ink Q into the accommodation space 93 is formed at the center of the cover 8. The ink supply port 81 is formed of a through-hole that penetrates through the cover 8 in the thickness direction. In addition, an end of the tube 203 on the downstream side (lower end) is located separately on the upper side of the ink supply port 81, and the ink Q dropping from a discharge port (opening) 203*a* of the tube 203 passes through the ink supply port 81, enters the container main body 9, and is then absorbed by the ink absorbing members 10. Note that the ink supply port 81 may be formed at a location deviating from the center of the cover 8.

The cover 8 may have absorbability with which the ink Q is absorbed or may have liquid repellency with which the ink Q is repelled.

The thickness of the cover 8 is not particularly limited, is preferably equal to or greater than 1 mm and equal to or less than 20 mm, and is more preferably equal to or greater than 8 mm and equal to or less than 10 mm, for example. Note that the cover 8 is not limited to the cover in the plate shape within such a numerical range, and a cover with a film shape (sheet shape) that is thinner than that may also be employed. In this case, the thickness of the cover 8 is not particularly limited and is preferably equal to or greater than 10 μm and less than 1 mm.

Incidentally, the ink Q discharged from the tube 203 is absorbed by the ink absorbing members 10 in the container main body 9 via the ink supply port 81. When the ink Q lands on the ink absorbing members 10, the water-absorbable resin 30 or the fiber 20 (including the fiber 20 in a state in which the fiber 20 retains the water-absorbable resin 30) that are constituent material of the ink absorbing member 10 jumps up due to impact at that time in some cases (hereinafter, the jumping constituent material of the ink absorbing member 10 will be referred to as "dust 300").

If the dust 300 jumps up, some part of the dust 300 is directed to the ink supply port 81. According to the invention, it is possible to prevent the dust 300 from flying to the outside of the ink supply port 81 by providing the flying preventing mechanism 3. Hereinafter, the flying preventing mechanism 3 will be described.

As illustrated in FIGS. 1, 4, and 5, the flying preventing mechanism 3 is formed of a shutter 4 provided on the upper side of the cover 8.

The shutter 4 has an opening and closing plate 41 (shutter plate) and a drive source 42 that moves the opening and closing plate 41.

The opening and closing plate 41 is arranged on the upper surface of the cover 8 and is arranged in such an orientation that the thickness direction thereof coincides with the thickness direction of the cover 8. The opening and closing plate 41 can slide on the upper surface of the cover 8. The size of the opening and closing plate 41 is greater than the opening area of the ink supply port 81 in a plan view and is such a size that the opening and closing plate 41 sufficiently blocks (covers) the ink supply port 81 in a state in which the opening and closing plate 41 is overlaid with the ink supply port 81.

The constituent material of the opening and closing plate 41 is not particularly limited, and for example, it is possible to use various metal materials, various resin materials, and the like.

The drive source 42 is a direct-operated solenoid actuator that is driven by energization and is connected to the opening and closing plate 41 via a shaft core 421. It is possible to operate the opening and closing plate 41 to move by the drive source 42 being operated. Therefore, the drive source 42 can be both in the opened state illustrated in FIG. 4 and the closed state illustrated in FIG. 5.

In the opened state illustrated in FIG. 4, the opening and closing plate 41 is located at a location deviating from the ink supply port 81, and the accommodation space 93 communicates with the outside of the container main body 9. In the opened state, the ink Q can pass through the ink supply port 81, and it is possible to supply the ink Q into the accommodation space 93.

Meanwhile, in the closed state illustrated in FIG. 5, the opening and closing plate 41 is located at a location that is overlaid with the ink supply port 81, and the opening and closing plate 41 is in a state in which the opening and closing plate 41 is blocking the ink supply port 81. In the closed state, it is possible to prevent the dust 300 from flowing out of the accommodation container 7 via the ink supply port 81.

In this manner, the flying preventing mechanism 3 has the shutter 4 capable of opening and closing the ink supply port 81 (inlet port). It is possible to prevent the dust 300 from flying from the inlet port to the outside of the accommodation container 7 by blocking the ink supply port 81 with the shutter 4. As a result, it is possible to prevent the dust 300 from entering a nozzle 203*a* and to prevent clogging in the nozzle 203*a*, for example.

Note that the opening and closing plate 41 is not limited to the slide type as described above, and a turning-type opening and closing plate or the like may also be employed. A plurality of opening and closing plates 41 may also be provided. In this case, the opening and closing plates are not particularly limited to the slide type, the turning type, or the like as described above.

Although the drive source 42 is a direct-operated solenoid actuator in the embodiment, the drive source 42 is not limited thereto and may be a configuration that is driven by a motor, for example.

The drive source 42 as described above is electrically connected to the control section 2 illustrated in FIGS. 1 and 3 to 5, and operations thereof are controlled.

The control section 2 has a CPU 21 (processor) and a storage section 22 (a memory, a hard disk, or the like). The control section 2 is electrically connected to the drive source 42 and the roller section 204*a*.

The CPU 21 executes various programs stored in the storage section 22. The storage section 22 stores various programs such as a program or the like related to control of the drive source 42.

Note that the control section 2 may be placed outside the accommodation container 7 (for example, at an any location in the print apparatus 200), for example, and the control section 2 may be an external control device that is placed outside the print apparatus 200.

In addition, communication between the control section 2 and the drive source 42 or the roller section 204*a* may be performed in either a wired or wireless manner or may be performed via the Internet or the like.

The control section 2 may be common to the control section that controls operations of the respective parts of the print apparatus 200. That is, the control section 2 may have a function of controlling the print apparatus 200.

Next, control operations of the control section 2 will be described with reference to the flowchart illustrated in FIG. 6. Note that the following description will be given on the assumption of a state in which the print apparatus 200 is performing printing. The shutter 4 is in a closed state in an initial state and during printing.

First, whether or not the roller section 204*a* (see FIG. 1) has been operated is determined in Step S101. The determination is made by detecting energization to the roller section 204*a* or detecting an encoder value of the roller section 204*a*, for example.

In a case in which it is determined that the roller section 204*a* has been operated in Step S101, energization to the drive source 42 of the shutter 4 is performed, and the shutter 4 is brought into the opened state (Step S102).

Next, whether or not the operation of the roller section 204*a* has been stopped is determined. Note that the determination in the step is performed similarly to Step S101 by detecting energization to the roller section 204*a* or by detecting the encoder value of the roller section 204*a*.

In a case in which it is determined that the operation of the roller section 204*a* has been stopped in Step S103, energization to the drive source 42 of the shutter 4 is performed, and the shutter 4 is brought into the closed state (Step S104). In this manner, it is possible to block the ink supply port 81 with the shutter 4. Therefore, it is possible to prevent the dust 300 generated when the ink Q lands on the ink absorbing member 10 from flying from the ink supply port 81 to the outside of the accommodation container 7. As a result, it is possible to prevent the dust 300 from entering the nozzle 203*a* and to prevent clogging of the nozzle 203*a*, for example.

Note that the shutter 4 is brought into the closed state in a predetermined time after it is determined that the operation of the roller section 204*a* has been stopped in the embodiment. The "predetermined time" can be set to an experimentally obtained value of a time before the ink Q actually passes through the ink supply port 81 after the operation of the roller section 204*a* is stopped. In this manner, it is possible to more reliably bring the shutter 4 into the opened state when the ink Q passes through the ink supply port 81.

The invention is not limited thereto, and the shutter 4 may be brought into the closed state at the same time with the stopping of the operation of the roller section 204*a*.

In this manner, the flying preventing mechanism 3 has the control section 2 that controls operations of the shutter 4 in synchronization with passing of the ink Q through the ink supply port 81 (inlet port). In this manner, it is possible to bring the shutter 4 into the opened state at a timing at which the ink Q passes through the ink supply port 81 and to bring the shutter 4 into the closed state if the passing of the ink Q has been completed. That is, it is possible to achieve both the passing of the ink Q and the prevention of the dust 300 from flowing out.

In Step S105, whether or not printing has been completed is determined. In a case in which the printing has been completed, the shutter 4 is maintained in the closed state, and the control operation is ended. In a case in which it is determined that printing has not been completed, the processing returns to Step S101, and the following control operation is repeated.

Since the flying preventing mechanism 3 is included as described above according to the invention, it is possible to prevent the constituent material of the ink absorbing member 10 from flying from the ink supply port 81 to the outside of the accommodation container 7. Therefore, it is possible to prevent the constituent material of the ink absorbing member 10 from entering the nozzle 203*a* or the like located outside the accommodation container 7.

Second Embodiment

Figure 7:
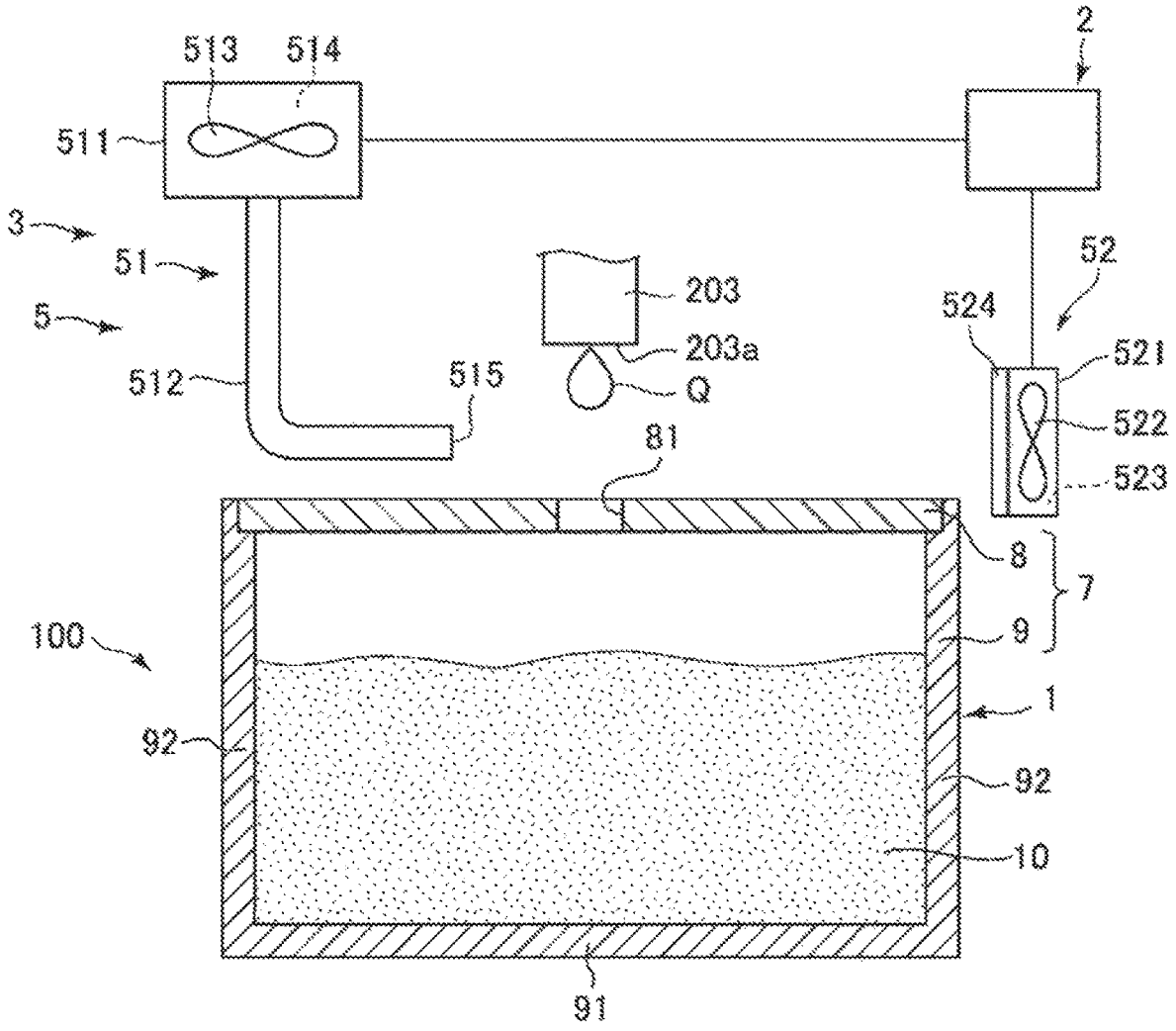
FIG. 7 is a partial vertical sectional view illustrating a state (example) in which an ink absorbing structure (ink absorbing member accommodation container) according to a second embodiment of the invention is used and is a diagram illustrating a state in which operations of a blowing section are stopped.
Figure 8:
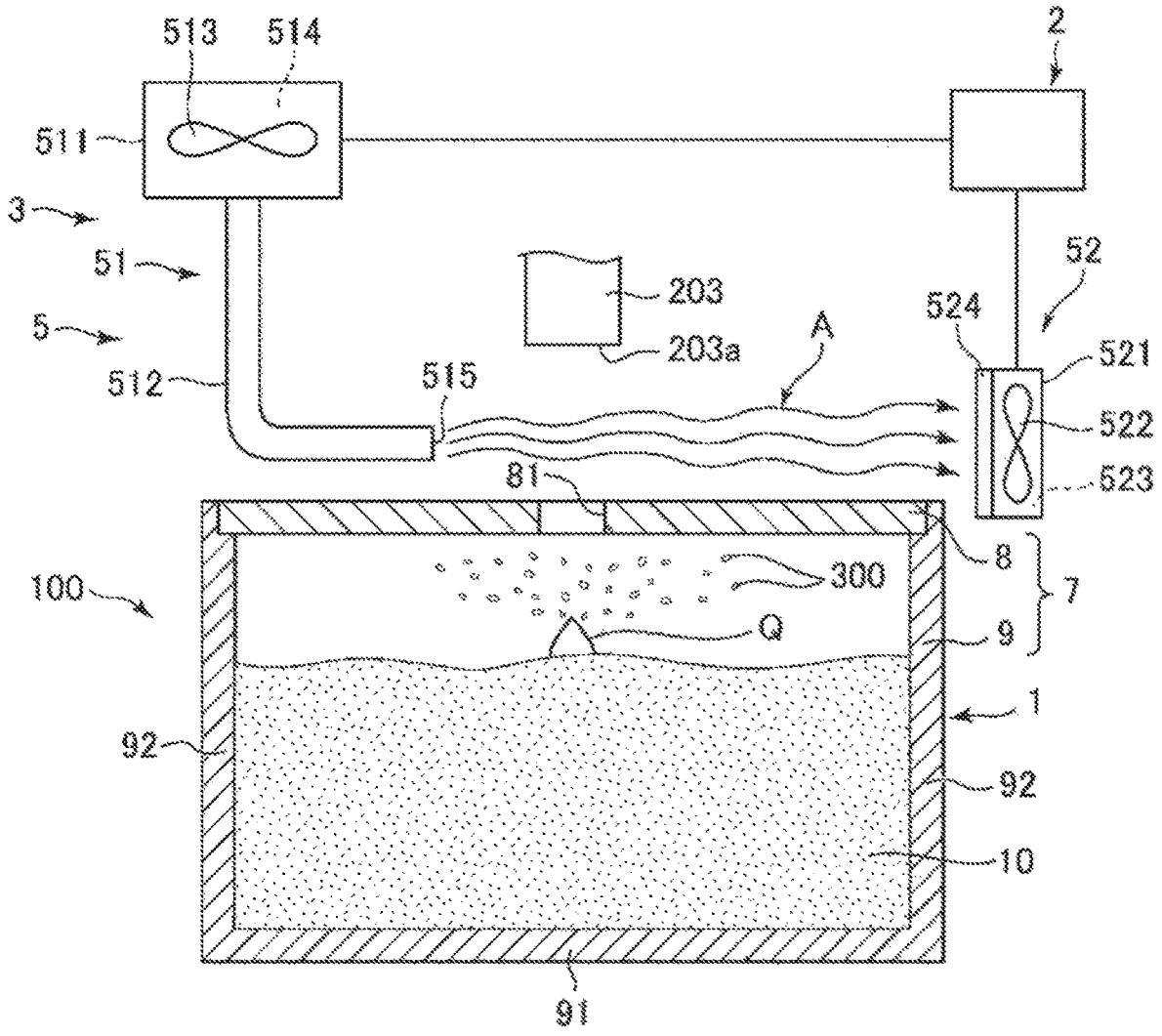
FIG. 8 is a partial vertical sectional view illustrating a state (example) in which an ink absorbing structure (ink absorbing member accommodation container) according to a second embodiment of the invention is used and is a diagram illustrating a state in which a blowing section is being operated.

FIG. 7 is a partial vertical sectional view illustrating a state (example) in which an ink absorbing structure (ink absorbing member accommodation container) according to a second embodiment of the invention is used and is a diagram illustrating a state in which operations of the blowing section are stopped. FIG. 8 is a partial vertical sectional view illustrating a state (example) in which the ink absorbing structure (ink absorbing member accommodation container) according to the second embodiment of the invention is used and is a diagram illustrating a state in which the blowing section is being operated.

Hereinafter, the second embodiment of the ink absorbing member accommodation container and the ink absorbing structure according to the invention will be described with reference to the drawings, differences from the aforementioned embodiment will be mainly described, and description of similar matters will be omitted.

The embodiment is similar to the first embodiment other than that configurations of the flying preventing mechanism differ from each other.

As illustrated in FIGS. 7 and 8, the flying preventing mechanism 3 according to the embodiment has an air flow formation section 5 that forms an air flow moving across an ink supply port 81 (inlet port) outside the ink supply port 81 (inlet port).

The air flow formation section 5 has a blowing section 51 that serves as an upstream-side air feeding section placed on the upstream side of the ink supply port (inlet port) and a suctioning section 52 that serves as a downstream-side air feeding section placed on the downstream side of the ink supply port 81 (inlet port). The blowing section 51 has a blowing fan 511 and a blowing pipe 512.

The blowing fan 511 has a rotation blade 513 and a rotation drive source 514 (motor) that drives and rotates the rotation blade 513 and is placed at a location above the cover 8 deviating from the ink supply port 81. The blowing pipe 512 is connected to the blowing fan 511.

The blowing pipe 512 has a function of changing an orientation of the air flow formed by the blowing fan 511. In the embodiment, a blowing port 515 of the blowing pipe 512 is directed in the horizontal direction. In this manner, it is possible to form an air flow A moving across the ink supply port 81.

The suctioning section 52 has a function of suctioning air discharged from the blowing port 515 of the blowing pipe 512. The suctioning section 52 has a suctioning fan 521. The suctioning fan 521 is located at a position at which the suctioning fan 521 faces the blowing port 515 of the blowing pipe 512 via the ink supply port 81.

The suctioning fan 521 has a rotation blade 522 and a rotation drive source 523 (motor) that drives and rotates the rotation blade 522. The rotation blade 522 rotates about a rotation axis in the horizontal direction. In this manner, it is possible to suction air discharged from the blowing port 515 of the blowing pipe 512 and to stably hold the orientation of the air flow A.

A filter 524 is provided on the side of the suctioning section 52 of the suctioning fan 521. The filter 524 is formed of a mesh, for example, and has a function of complementing a minute subject such as dust 300. In this manner, it is possible to prevent the suctioning fan 521 from suctioning the minute subject.

Such a suctioning fan 521 is placed at a wall (not illustrated) that sections a space where the ink absorbing member accommodation container 1 is placed, and the air suctioned by the suctioning fan 521 is discharged to the outside.

The air flow A formed by such an air flow formation section 5 functions as an air curtain. That is, it is possible to prevent the dust 300 directed from the ink supply port 81 to the outside from flowing to the outside of the accommodation container 7 and to prevent the dust 300 from flying outside the accommodation container 7.

In this manner, the flying preventing mechanism 3 has the air flow formation section 5 that forms the air flow A moving across the ink supply port 81 (inlet port) outside the ink supply port 81 (inlet port) according to the embodiment. It is possible to prevent the dust 300 from flying from the ink supply port 81 to the outside of the accommodation container 7 by forming the air flow A moving across the ink supply port 81.

The rotation drive source 514 of the blowing section 51 and the rotation drive source 523 of the suctioning section 52 are electrically connected to the control section 2, respectively, and operations thereof are controlled.

The control section 2 operates the air flow formation section 5 to achieve a state in which the air flow A is formed when the roller section 204*a* (see FIG. 1) is stopped similarly to the first embodiment. If the operation of the roller section 204*a* is detected, then the operation of the air flow formation section 5 is stopped, and a state in which the ink Q can pass through the ink supply port 81 is achieved. Then, if stopping of the operation of the roller section 204*a* is detected, the operation of the air flow formation section 5 is restarted, and the air flow A moving through the ink supply port 81 is formed. In this manner, it is possible to prevent the dust 300 from flowing from the ink supply port 81 to the outside of the accommodation container 7.

In this manner, the flying preventing mechanism 3 has the control section 2 that controls the operations of the air flow formation section 5 in synchronization with the passing of the ink Q through the ink supply port 81 (inlet port). In this manner, it is possible to stop the operations of the air flow formation section 5 at the timing at which the ink Q passes through the ink supply port 81 and to restart the operations of the air flow formation section 5 if the passing of the ink Q is completed. That is, it is possible to achieve both the passing of the ink Q and the prevention of the dust 300 from flowing out.

Also, the control is not limited to the control for switching the air flow formation section 5 between an operating state and a stopping state as described above, and for example, the orientation of the blowing section 51 may be changed, or an electromagnetic valve may be provided at a midpoint of the blowing section 51 and opening and closing of the electromagnetic valve may be controlled, or a rectifying plate may be provided at the blowing port 515 and control for changing the orientation of the rectifying plate may be performed. That is, the control is not limited to the aforementioned control as long as control of switching whether or not the air flow A is present immediately above the ink supply port 81 is performed.

Third Embodiment

Figure 9:
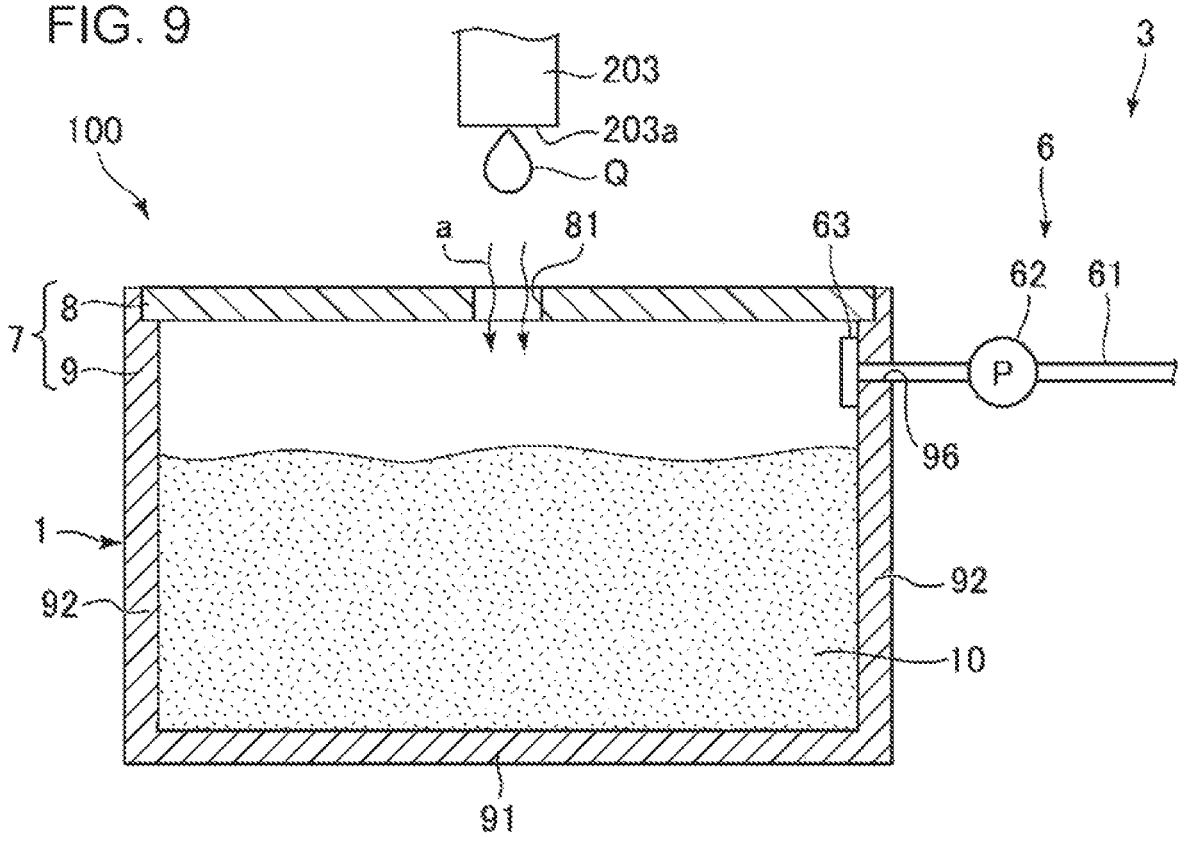
FIG. 9 is a partial vertical sectional view illustrating a state (example) in which an ink absorbing structure (ink absorbing member accommodation container) according to a third embodiment of the invention is used and is a diagram illustrating a state in which operations of a suctioning section is stopped.
Figure 10:
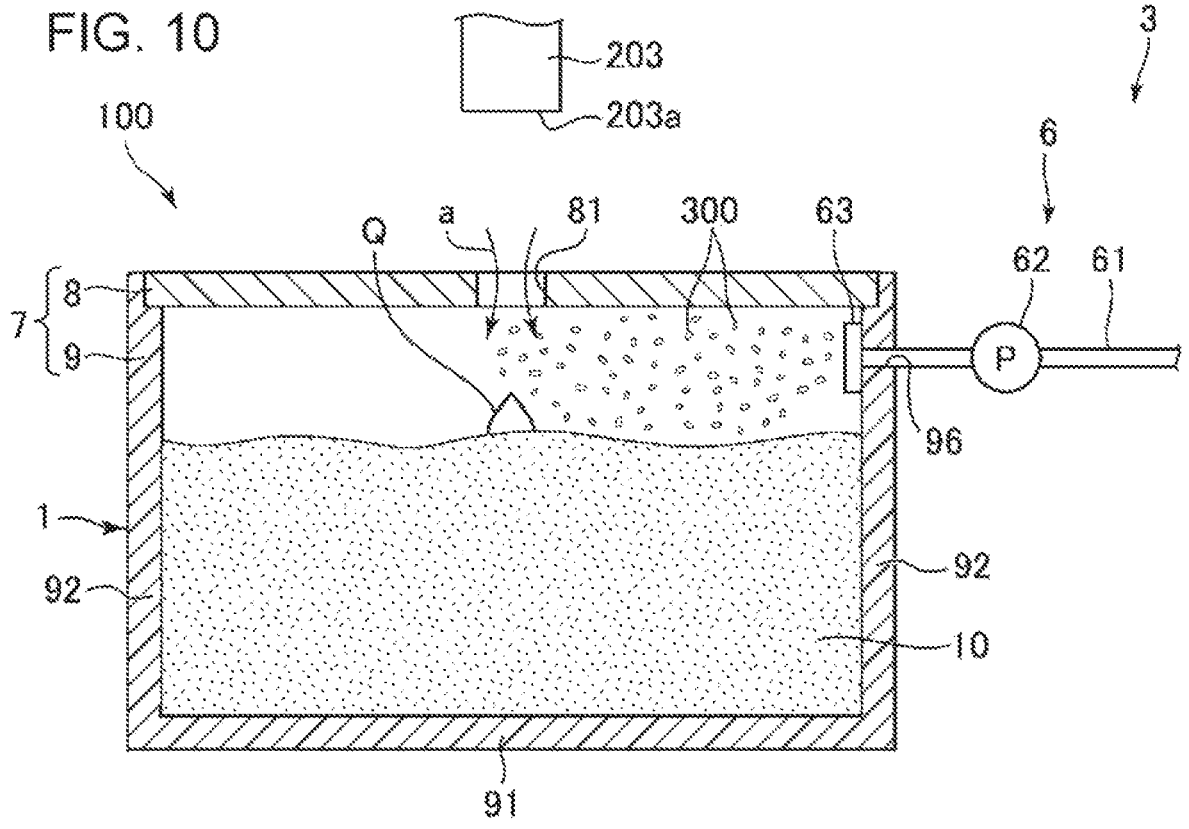
FIG. 10 is a partial vertical sectional view illustrating a state (example) in which an ink absorbing structure (ink absorbing member accommodation container) according to a third embodiment of the invention is used and is a diagram illustrating a state in which a suctioning section is being operated.

FIG. 9 is a partial vertical sectional view illustrating a state (example) in which an ink absorbing structure (ink absorbing member accommodation container) according to a third embodiment of the invention is used and is a diagram illustrating a state in which operations of the suctioning section are stopped. FIG. 10 is a partial vertical sectional view illustrating a state (example) in which the ink absorbing structure (ink absorbing member accommodation container) according to the third embodiment of the invention is used and is a diagram illustrating a state in which the suctioning section is being operated.

Hereinafter, the third embodiment of the ink absorbing member accommodation container and the ink absorbing structure according to the invention will be described with reference to the drawings, differences from the aforementioned embodiments will be mainly described, and description of similar matters will be omitted.

The embodiment is similar to the first embodiment other than that configurations of the flying preventing mechanism differ from each other.

As illustrated in FIGS. 9 and 10, the flying preventing mechanism 3 has a negative pressure formation section 6 that reduces a pressure in the accommodation space 93 to a negative pressure in the embodiment. The negative pressure formation section 6 has a suctioning pipe 61, a suctioning pump 62 connected to the suctioning pipe 61, and a filter 63.

The suctioning pipe 61 has one end inserted into a through-hole 96 formed in the side wall sections 92 in an air tight manner. The suctioning pipe 61 is placed such that the accommodation space 93 communicates with the outside. Also, the filter 63 is placed at an end of the suctioning pipe 61 on the side of the accommodation space 93. In this manner, it is possible to complement the dust 300 suctioned and directed to the suctioning pipe 61.

Also, the suctioning pump 62 is provided at the midpoint of the suctioning pipe 61. The suctioning pump 62 is formed of an ejector, for example, can suction air in the accommodation space 93 via the suctioning pipe 61 by being operated, and can discharge the air to the outside. In this manner, it is possible to reduce the pressure in the accommodation space 93 to the negative pressure as compared with the outside of the accommodation container 7 (ambient air). Therefore, it is possible to generate an air flow a directed from the ink supply port 81 to the accommodation space 93 and to prevent the dust 300 from flowing to the outside of the ink supply port 81.

In the embodiment, it is possible to complement the dust 300 directed to the suctioning pipe 61 due to suctioning force of the negative pressure formation section 6 with the filter 63. Note that the filter 63 may be omitted, and the dust 300 may be discharged.

In this manner, it is possible to reduce the pressure in the accommodation space 93 to the negative pressure and to prevent the dust 300 from flying from the inlet port to the outside of the accommodation container 7 by the flying preventing mechanism 3 having the negative pressure formation section 6 that reduces the pressure in the accommodation space 93 to the negative pressure.

In the embodiment, the negative pressure formation section 6 performs suctioning when the ink Q is supplied and when the ink Q passes through the ink supply port 81 and lands on the ink absorbing members 10 in the embodiment. That is, the negative pressure formation section 6 is in a constantly operating state. In this manner, the air flow a directed from the outside to the inside of the accommodation space 93 is constantly formed at the ink supply port 81 as illustrated in FIGS. 9 and 10. Therefore, the ink Q can pass through the ink supply port 81 with higher accuracy due to the air flow a and can land on the ink absorbing member 10.

Note that the invention is not limited to the above description, and the negative pressure formation section 6 may be operated if the passing of the ink Q is completed, for example.

Fourth Embodiment

Figure 11:
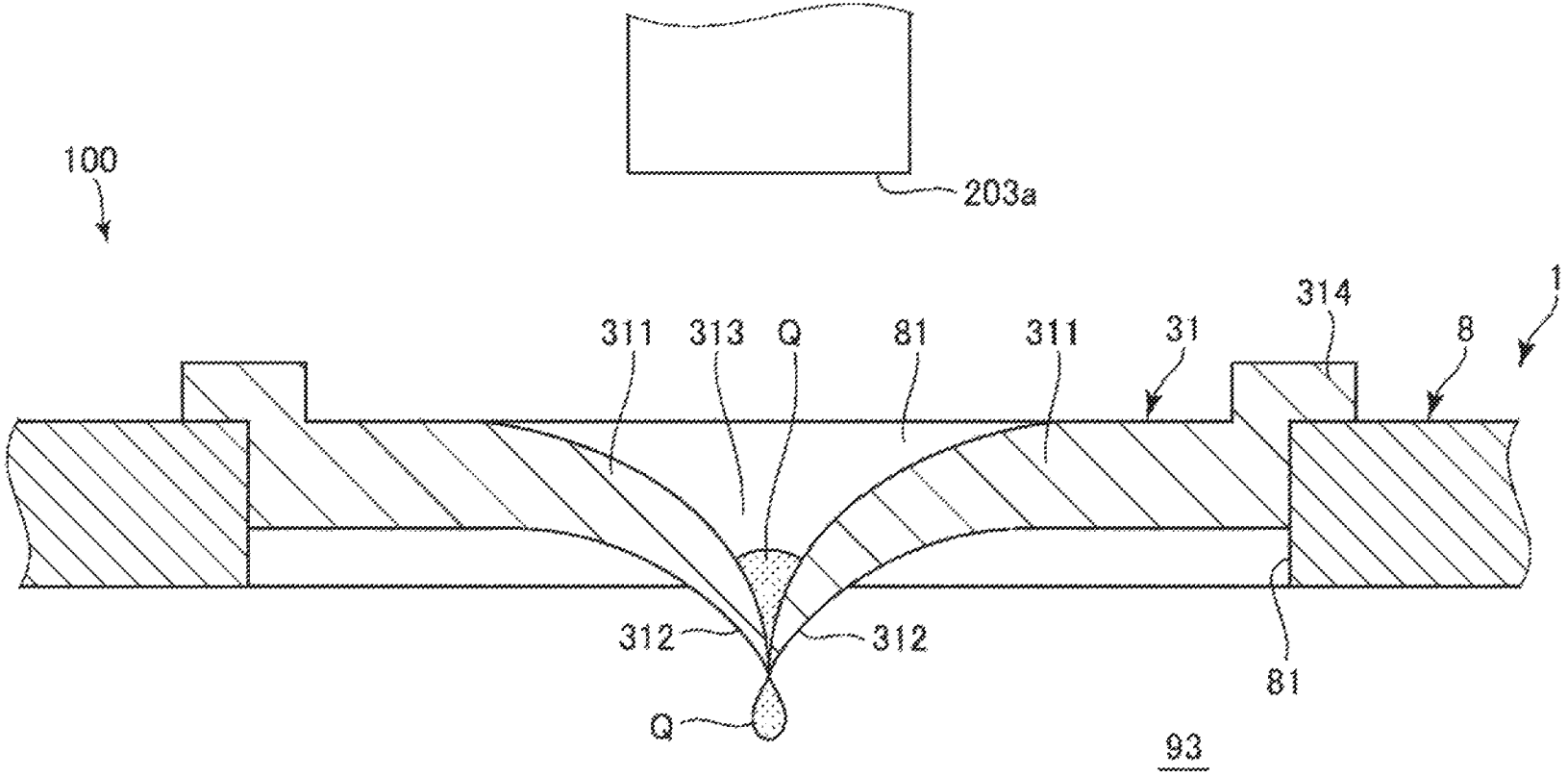
FIG. 11 is a vertical sectional view illustrating a flying preventing mechanism included in an ink absorbing structure (ink absorbing member accommodation container) according to a fourth embodiment of the invention.

FIG. 11 is a vertical sectional view illustrating a flying preventing mechanism included in an ink absorbing structure (ink absorbing member accommodation container) according to a fourth embodiment of the invention.

Hereinafter, the fourth embodiment of the ink absorbing member accommodation container and the ink absorbing structure according to the invention will be described with reference to the drawing, differences from the aforementioned embodiments will be mainly described, and description of similar matters will be omitted.

The embodiment is similar to the first embodiment other than configurations of the flying preventing mechanism differ from each other.

As illustrated in FIG. 11, the flying preventing mechanism 3 has a check valve 31 provided in order to block the ink supply port 81 in the embodiment. The check valve 31 is formed of a so-called duckbill valve. The check valve 31 has two tongue pieces 311 formed of elastic bodies such as rubber or thermoplastic elastomer, for example. Both the tongue pieces 311 have tip ends 312 tightly adhering (contact) to each other in a bent state. Both the tongue pieces 311 are bent such that the tip ends 312 enter the side of the accommodation space 93. Also, the edge of the check valve 31 is a ring-shaped securing section 314. In this manner, the check valve 31 is secured over the entire circumference of the edge of the ink supply port 81.

A depression 313 (liquid accumulated section) is formed between the tip ends 312 of both the tongue pieces 311. If the ink Q ejected from the nozzle 203*a* is accumulated in the depression 313 and reaches a predetermined weight, a liquid pressure (gravity) of the ink Q act against elastic force (adhesion force) of both the tongue pieces 311 to press and open both the tongue pieces 311, and the ink Q is thus dropped into the accommodation space 93. If a predetermined amount of ink Q is dropped, then both the tongue pieces 311 tightly adhere to each other due to the elastic force.

In this manner, the flying preventing mechanism 3 has the check valve 31 provided at the ink supply port 81 (inlet port) in the embodiment. In this manner, it is possible to prevent the dust 300 from flying from the ink supply port 81 to the outside of the accommodation container 7. Electrical control is not necessary, and it is possible to exhibit the aforementioned advantages with a simple configuration. In this manner, the check valve 31 can also be referred to as a self-shutter.

Note that although the duckbill valve has been described as an example of the check valve in the embodiment, the invention is not limited thereto, and any configuration can be used as long as the valve body has similar functions.

Although the ink absorbing member accommodation container and the ink absorbing structure according to the invention have been described above on the basis of the embodiments illustrated in the drawings, the invention is not limited thereto, and the respective parts that form the ink absorbing member accommodation container and the ink absorbing structure can be replaced with any configurations that can exhibit similar functions. Also, any configurations may be added thereto.

The ink absorbing member accommodation container and the ink absorbing structure according to the invention may be combinations of any two or more configurations (features) in the respective embodiments.

Although the ink absorbing members are fiber in the cotton form in the aforementioned respective embodiments, the ink absorbing members are not limited thereto and may have sheet shapes or small piece shapes (strip shapes) that are smaller than the sheet shapes. Also, the ink absorbing members may be formed only of water-absorbable resin by omitting the fiber.

The entire disclosure of Japanese Patent Application No. 2018-059712 filed Mar. 27, 2018 is expressly incorporated herein by reference.

What is claimed is:

1. An ink absorbing member accommodation container comprising:

an accommodation container that has an accommodation space for accommodating an ink absorbing member containing water-absorbable resin capable of absorbing ink inside the accommodation container and that includes an inlet port through which the ink flows into the accommodation space; and a flying preventing mechanism that prevents a constituent material of the ink absorbing member from flying from the inlet port to an outside of the accommodation container, wherein a constituent material of the ink absorbing member includes the water-absorbable resin and fiber, and the fiber retains the water-absorbable resin, and wherein the flying preventing mechanism has one of the following:

an air flow formation section that forms an air flow moving across the inlet port outside the inlet port;

a negative pressure formation section that reduces a pressure in the accommodation space to a negative pressure; or a check valve provided at the inlet port.

2. The ink absorbing member accommodation container according to claim 1, wherein the flying preventing mechanism has a control section that controls operations of the air flow formation section in synchronization with passing of the ink through the inlet port.

3. An ink absorbing structure comprising:

the ink absorbing member accommodation container according to claim 2; and the ink absorbing member that is accommodated in the ink absorbing member accommodation container and that includes the water-absorbable resin.

4. The ink absorbing member accommodation container according to claim 1, wherein the fiber is a fiber-separated product in a cotton form.

5. An ink absorbing structure comprising:

the ink absorbing member accommodation container according to claim 4; and the ink absorbing member that is accommodated in the ink absorbing member accommodation container and that includes the water-absorbable resin.

6. An ink absorbing structure comprising:

the ink absorbing member accommodation container according to claim 1; and the ink absorbing member that is accommodated in the ink absorbing member accommodation container and that includes the water-absorbable resin.

* * * * *